US006762548B2

(12) United States Patent
Bechtel et al.

(10) Patent No.: US 6,762,548 B2
(45) Date of Patent: Jul. 13, 2004

(54) COLOR PICTURE SCREEN WITH BLUE PHOSPHOR LAYER

(75) Inventors: Hans-Helmut Bechtel, Roetgen (DE); Wolfgang Busselt, Roetgen (DE); Thomas Juestel, Aachen (DE); Martin Weibrecht, Aachen (DE); Peter Quadflieg, Aachen (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 92 days.

(21) Appl. No.: 09/942,488

(22) Filed: Aug. 30, 2001

(65) Prior Publication Data

US 2002/0047510 A1 Apr. 25, 2002

(51) Int. Cl.[7] ..... H01J 1/62; H01J 63/04; H01J 61/44

(52) U.S. Cl. ..... 313/485; 313/486; 313/487; 313/461; 313/467; 313/473; 252/301.4 R

(58) Field of Search ..... 313/435, 486, 313/487, 461, 466, 467, 473; 252/301.4 R

(56) References Cited

U.S. PATENT DOCUMENTS

| | | | | | |
|---|---|---|---|---|---|
| 4,604,550 | A | * | 8/1986 | van Koesveld et al. | 313/478 |
| 5,200,667 | A | * | 4/1993 | Iwasaki et al. | 313/478 |
| 5,277,841 | A | | 1/1994 | Jeong et al. | 252/301.6 |
| 5,684,359 | A | * | 11/1997 | Yano et al. | 313/487 |
| 5,866,977 | A | | 2/1999 | Lee et al. | 313/463 |
| 5,998,918 | A | * | 12/1999 | Do et al. | 313/473 |
| 6,010,644 | A | * | 1/2000 | Fu et al. | 252/301.4 R |

FOREIGN PATENT DOCUMENTS

| | | | | |
|---|---|---|---|---|
| JP | 02120389 A | * | 5/1990 | C09K/11/08 |
| JP | 02135276 A | * | 5/1990 | C09K/11/08 |

* cited by examiner

*Primary Examiner*—Nimeshkumar D. Patel
*Assistant Examiner*—Sikha Roy

(57) ABSTRACT

The invention relates to a color picture screen with an improved blue light emission. The blue phosphor layer comprises a first blue-emitting phosphor and a second phosphor which shows a light emission in the range from 380 to 450 nm.

8 Claims, 1 Drawing Sheet

COLOR PICTURE SCREEN WITH BLUE PHOSPHOR LAYER

Figure 1:
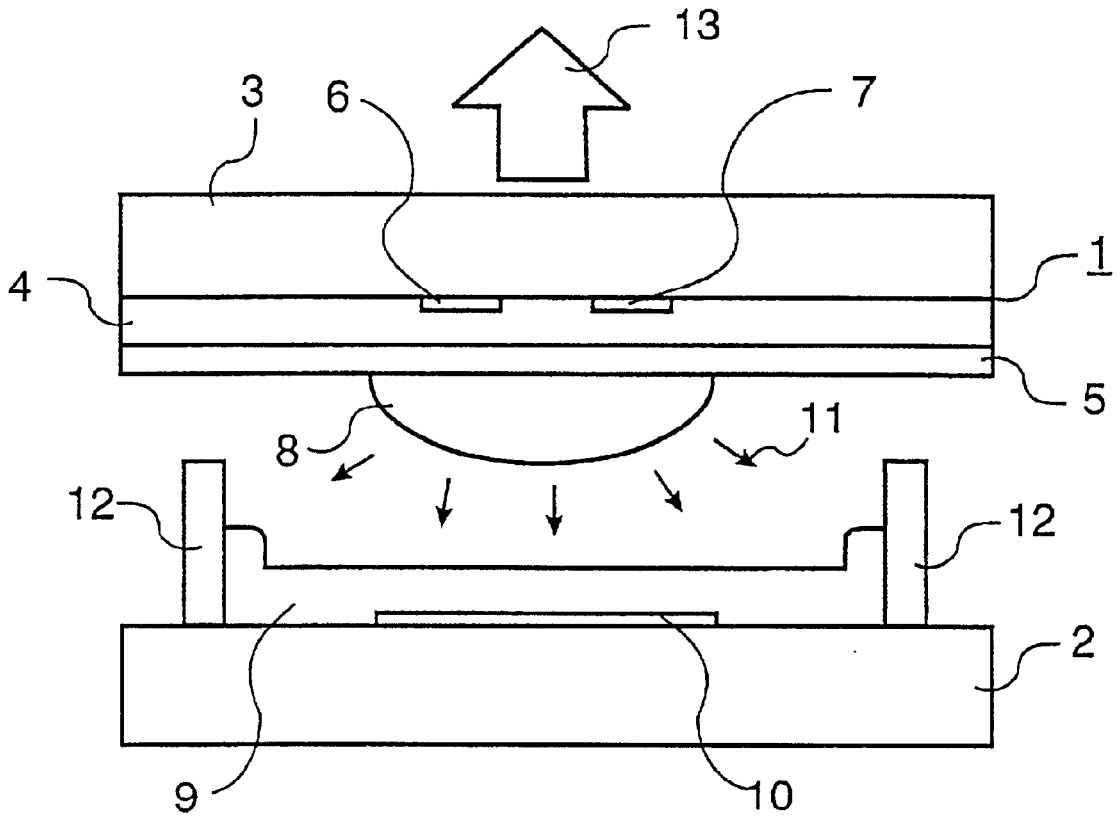

The invention relates to a color picture screen, in particular a plasma picture screen, provided with a blue phosphor layer.

Additive color mixing takes place for displaying color pictures on picture screens. A major portion of the colors occurring in nature can be represented through additive mixing of the three primary colors red, green and blue in suitable intensities. This principle is used both in emitting picture screens such as cathode ray tubes or plasma picture screens and in non-emitting picture screens such as liquid crystal picture screens.

The representation of the various colors is laid down in so-called standard color curves. A widely used standard is the CIE color triangle. The range of the colors which can be represented by a picture screen is defined by the color points of the three phosphors, which again are dependent on the respective emission spectra.

The characteristic color sensitivity of the human eye has for its consequence that the blue light emission contributes least to the luminance (brightness) of a picture screen. In addition, the blue-emitting phosphors are not as efficient as the green- and red-emitting phosphors in plasma picture screens. These two effects have the result that the color temperature for white light is lower than desired in TV applications.

It is accordingly an object of the invention to provide a color picture screen provided with an improved blue-emitting phosphor layer.

This object is achieved by means of a color picture screen provided with a blue phosphor layer which comprises a first phosphor having a light emission in the range from 430 to 490 nm and a second phosphor having a light emission in the range from 380 to 450 nm.

Preferably, the second phosphor has a light emission in the range from 380 to 420 nm.

The combination of a first blue-emitting phosphor with a second phosphor whose light emission is still just in the visible range and is a deep violet achieves a blue light emission which appears "bluer" and has a strong color saturation. White light is obtained in this manner which has a high luminance and a high apparent color temperature.

It is particularly preferred that the second phosphor is chosen from the group comprising $Tb^{3+}$-activated phosphors, $Eu^{2+}$-activated phosphors, $Bi^{3+}$-activated phosphors, $Ga^{3+}$-activated phosphors, and $Ce^{3+}$-activated phosphors.

It is particularly highly preferred that the second phosphor is chosen from the group comprising LaOBr:Tb, $Y_2O_2S$:Tb, $Y_3Al_5O_{12}$:Tb, $Ca_3(PO_4)_2$:Eu, $Sr_2P_2O_7$:Eu, $(Sr,Mg)_2P_2O_7$:Eu $CaB_2P_2O_9$:Eu, $CaSO_4$:Eu, CaO:Bi, ZnO:Ga and $(Y,Gd)BO_3$:Ce.

All these phosphors efficiently emit light with a wavelength between 380 and 450 nm when excited by UV radiation or an electron ray.

It is preferred that the phosphor layer comprises a physical mixture of particles of the first phosphor and particles of the second phosphor.

It is favorable when the proportional quantity of the second phosphor in the phosphor layer lies between 5 and 50% by weight in relation to the quantity of the first phosphor.

This embodiment can be realized in a simple manner because the second phosphor may be simply added to the suspension of the phosphor with which the phosphor layer is manufactured.

It may also be preferred that the phosphor layer has a base layer comprising the first phosphor and a covering layer comprising the second phosphor.

It is preferred that the first phosphor is chosen from the group comprising ZnS:Ag, $BaMgAl_{10}O_{17}$:Eu and $(Ba,Sr,Ca)_5(PO_4)_3Cl$:Eu.

The phosphor ZnS:Ag is particularly suitable for use as a blue-emitting phosphor in color cathode ray tubes because it emits blue light efficiently under excitation by an electron ray. The blue-emitting phosphors $BaMgAl_{10}I_{17}$:Eu and $(Ba,Sr,Ca)_5(PO_4)_3Cl$:Eu are particularly suitable for use in plasma picture screens, because they combine a high color saturation with an efficient conversion of UV radiation into blue light. In addition, they are resistant to the thermal loads prevailing during the manufacture of the plasma picture screens.

It is furthermore preferred that the color picture screen is chosen from the group comprising cathode ray tubes, plasma picture screens, and liquid crystal picture screens.

These color picture screens provided with a blue phosphor layer according to the invention show an enhanced luminance, because higher proportional quantities of red and green light can be used for the color representation thanks to the improved blue light emission. The red and green light emissions contribute more strongly to the luminance of a color picture screen than does the blue light emission. It is furthermore advantageous that the color impression of white light is not changed in spite of the increased quantities of red and green light.

The invention will now be explained in more detail below with reference to a FIGURE and three embodiments, with FIG. 1 showing the construction and operating principle of a single plasma cell in an AC plasma picture screen.

In FIG. 1, a plasma cell of an AC plasma picture screen with a coplanar arrangement of the electrodes comprises a front plate 1 and a carrier plate 2. The front plate 1 comprises a glass plate 3, and a dielectric layer 4, preferably made of glass containing PbO, is provided on the glass plate 3. Parallel, strip-shaped discharge electrodes 6, 7 are provided on the glass plate 3 and are covered by the dielectric layer 4. The discharge electrodes 6, 7 are made, for example, from metal or ITO. A protective layer 5, for example comprising MgO, is present on the dielectric layer 4.

The carrier plate 2 is made of glass, and parallel, strip-shaped address electrodes 10, for example made of Ag, are provided on the carrier plate 2 so as to run perpendicularly to the discharge electrodes 6, 7. Said address electrodes are covered with a phosphor layer 9 which emits in one of the three basic colors red, green, or blue. The individual plasma cells are separated from one another by means of a ribbed structure 12 with separating ridges which are preferably made of a dielectric material.

A gas is present in the plasma cell, i.e. between the discharge electrodes 6, 7 of which one acts as a cathode and the other as an anode alternately, preferably a rare gas mixture of, for example, He, Ne, or Kr, which comprises Xe as the UV radiation generating component. After a surface discharge has been ignited, so that charges can flow along a discharge path lying between the discharge electrodes 6, 7 in the plasma range 8, a plasma is formed in the plasma range 8 by which radiation 11 is generated in the UV range, in particular in the VUV range, depending on the composition of the gas. This radiation 11 excites the phosphor layer into luminescence, such that it emits visible light 13 in one of the three basic colors, which light issues through the front plate 1 to the exterior and thus represents a luminous pixel on the picture screen.

The blue-emitting phosphor used in the phosphor layer 9 may be, for example, a $Eu^{2+}$-activated phosphor such as $BaMgAl_{10}O_{17}$:Eu or $(Ba,Sr,Ca)_5(PO_{4)3}Cl$:Eu. The blue-emitting phosphor layer comprises besides this first phosphor with a light emission in the range from 430 to 490 nm also a second phosphor which has a light emission in the range from 380 to 450 nm, preferably in the range from 380 to 420 nm. The second phosphor may be chosen from the group of $Tb^{3+}$-activated phosphors, $Eu^{2+}$-activated phosphors, $Bi^{3+}$-activated phosphors, $Ga^{3+}$-activated phosphors, and $Ce^{3+}$-activated phosphors. The second phosphor may be chosen, for example, from the group comprising LaOBr:Tb, $Y_2O_2S$:Tb, $Y_3Al_5O_{12}$:Tb, $Ca_3(PO_4)_2$:Eu, $Sr_2P_2O_7$:Eu, $(Sr,Mg)_2P_2O_7$:Eu $CaB_2P_2O_9$:Eu, $CaSO_4$:Eu, CaO:Bi, ZnO:Ga and $(Y,Gd)BO_3$:Ce. It is advantageous when the concentration of $Tb^{3+}$ in the $Tb^{3+}$-activated phosphors is 0.1 mole % or less.

The green-emitting phosphor used may be, for example, $Zn_2SiO_4$:Mn, and the red-emitting phosphor may be, for example, $(Y,Gd)BO_3$:Eu in the phosphor layer 9.

Suitable manufacturing methods for a phosphor layer 9 are dry coating techniques, for example electrostatic deposition or electrostatically supported dusting, as well as wet coating processes, for example silk-screen printing, dispenser processes in which a suspension is provided by a nozzle moving along the channels, and sedimentation from the liquid phase.

In the wet coating processes, first a suitable first phosphor is dispersed in water, an organic solvent, possibly together with a dispersing agent, a surfactant, and an anti-foaming agent or a binder preparation. Suitable binder preparations for plasma picture screens are organic binders which withstand an operating temperature of 450° C. without decomposition, brittling, or discoloration, or organic binders which can be subsequently removed through oxidation. The second phosphor is added to the suspension mentioned above or a separate suspension of the second phosphor is prepared, depending on whether the blue phosphor layer is to comprise a physical mixture of particles of the first phosphor and particles of the second phosphor or a base layer of the first phosphor and a covering layer of the second phosphor.

Subsequently, the red- and green-emitting regions of the phosphor layer 9 are manufactured.

After the phosphor layer 9 has been provided, the carrier plate 2 is used together with further components, for example a front plate 1 and a rare gas mixture, for the manufacture of a plasma picture screen.

In principle, such a blue-emitting phosphor preparation may be used in all types of plasma picture screens such as, for example, AC plasma picture screens with or without matrix arrangement and DC plasma picture screens.

If the color picture screen is a liquid crystal color picture screen, the blue phosphor layer may be provided together with a red and a green phosphor layer on the inner side of the front plate. A liquid crystal color picture screen may further comprise a light source, a polarizer, a liquid crystal cell, and an analyzer.

If the color picture screen is a color cathode ray tube, the blue phosphor layer may be provided together with a red and a green phosphor layer on the inner side of the front plate. A color cathode ray tube may comprise, in addition to the front plate with the phosphor layer, an electron gun for the emission of at least one electron ray, a deflection device, a neck, and a cone which connects the front plate to the neck.

To generate the various colors, the respective regions of the phosphor layer are excited into luminescence by means of irradiation with an electron ray of varying intensity. The use of the blue phosphor layer according to the invention in a color cathode ray tube renders it possible to equalize the proportional current strengths for the generation of white light. This improves the luminance of the color cathode ray tube. In a color cathode ray tube with a shadow mask, the color stability is also improved, because deformations of the shadow mask cause fewer color changes.

Embodiments of the invention will be described in detail below, representing examples of how the invention may be carried into practice.

Embodiment 1

First a suspension of 40 g $BaMgAl_{10}O_{17}$:Eu and 2 g LaOBr:Tb (0.01 mole % $Tb^{3+}$) was prepared, to which additives such as an organic binder and a dispersing agent were added. The suspension was provided on a carrier plate 2 comprising a ribbed structure 12 and address electrodes 10 by means of silk-screen printing and dried. This process step was carried out subsequently for the other two phosphor types with the emission colors green and red.

All additives remaining in the phosphor layer 9 were removed by a thermal treatment of the carrier plate 2 at 400 to 600° C. in an atmosphere containing oxygen. Such a carrier plate 2 was then used together with a front plate 1 and a rare gas mixture for the manufacture of a plasma picture screen with a clearly higher apparent color temperature for white light.

Embodiment 2

First a suspension of $BaMgAl10O_{17}$:Eu was prepared, to which additives such as an organic binder and a dispersing agent were added. The suspension was provided on a carrier plate 2 comprising a ribbed structure 12 and address electrodes 10 by means of silk-screen printing and dried.

Then a suspension of $Sr_2P_2O_7$:Eu was prepared, to which additives such as an organic binder and a dispersing agent were added. This suspension was provided on the carrier plate 2 by means of silk-screen printing in those regions where previously the $BaMgAl_{10}O_{17}$:Eu had been provided, and was dried.

Furthermore, suspensions of phosphor types with the emission colors green and red were subsequently prepared, and additives such as an organic binder and a dispersing agent were added thereto. These suspensions were consecutively provided on the backplate 2 by means of silk-screen printing and dried.

All additives remaining in the phosphor layer 9 were removed by a thermal treatment of the carrier plate 2 at 400 to 600° C. in an atmosphere containing oxygen. Such a carrier plate 2 was then used together with a front plate 1 and a rare gas mixture for the manufacture of a plasma picture screen with a clearly higher apparent color temperature for white light.

Embodiment 3

First a suspension of 40 g ZnS:Ag and 4 g LaOBr:Tb (0.01 mole % $Tb^{3+}$) was prepared, to which additives such as an organic binder and a dispersing agent were added. The suspension was mixed with a 10% polyvinyl alcohol solution, and ammonium dichromate was also added to the suspension. The ratio of polyvinyl alcohol to ammonium dichromate was 10:1.

The resulting mixture was provided on the inner side of a front plate by means of spin coating. The layer thus manufactured was irradiated with UV light through a mask, whereby the polymer was crosslinked in the exposed regions. Then the non-crosslinked areas of the phosphor layer were washed away by spraying with hot water. The red and green regions of the phosphor layer, comprising $Y_2O_2S$:Eu and ZnS:Cu, respectively, were provided in a similar manner.

An aluminum layer was vapor-deposited on the phosphor layer, and the entire front plate was given a heat treatment for 1 hour at 250° C.

Such a front plate was used together with a neck, a cone connecting the front plate to the neck, an electron gun provided inside the neck for the emission of three electron rays, a deflection device, and a shadow mask for the construction of a color cathode ray tube.

In addition, a color cathode ray tube was manufactured with a blue phosphor layer comprising ZnS:Ag and 20% by weight of LaOBr:Tb. A color cathode ray tube with a blue phosphor layer comprising only ZnS:Ag was also manufactured.

TABLE 1 proportional current strengths for the individual phosphors in a color cathode ray tube for different proportional quantities of LaOBr:Tb in the ZnS:Ag blue phosphor layer for the generation of white light (D65; x = 0.313, y = 0.329).

| LaOBr:Tb [% by weight] | red comp. | green comp. | blue comp. |
|---|---|---|---|
| 0 | 0.42 | 0.33 | 0.23 |
| 10 | 0.40 | 0.32 | 0.27 |
| 20 | 0.37 | 0.30 | 0.32 |

Given a quantity of 20% by weight of $Tb^{3+}$-activated LaOBr in the blue phosphor layer comprising ZnS:Ag, the ratio of the currents with which the individual regions of the phosphor layer are excited for the emission of visible light in one of the three basic colors is substantially fully equalized for the generation of the color white.

What is claimed is:

1. A color picture screen provided with a blue phosphor layer comprising a mixture of:

particles of a first phosphor having a light emission in the range from 430 to 490 nm;

and particles of a second phosphor having a light emission in the range from 380 to 450 nm.

2. A color picture screen as claimed in claim 1, characterized in that the second phosphor has a light emission in the range from 380–420 nm.

3. A color picture screen as claimed in claim 1, characterized in that the second phosphor is chosen from the group comprising $Tb^{3+}$-activated phosphors, $Eu^{2+}$-activated phosphors, $Bi^{3+}$-activated phosphors, $Ga^{3+}$-activated phosphors, and $Ce^{3+}$-activated phosphors.

4. A color picture screen as claimed in claim 3, characterized in that the second phosphor is chosen from the group comprising LaOBr:Tb, $Y_2O_2S$:Th, $Y_3Al_5O_{12}$:Tb, $Ca_3(PO_4)_2$:Eu, $Sr_2P_2O_7$:Eu, $(Sr,Mg)_2P_2O_7$:Eu $CaB_2P_2O_9$:Eu, $CaSO_4$:Eu, CaO:Bi, ZnO:Ga and $(Y,Gd)BO_3$:Ce.

5. A color picture screen as claimed in claim 1, characterized in that the proportional quantity of the second phosphor in the phosphor layer lies between 5 and 50% by weight in relation to the quantity of the first phosphor.

6. A color picture screen as claimed in claim 1, characterized in that the phosphor layer has a base layer and a covering layer.

7. A color picture screen as claimed in claim 1, characterized in that the first phosphor is chosen from the group comprising ZnS:Ag, $BaMgAl_{10}O_{17}$:Eu and $(Ba,Sr,Ca)_5(PO_4)_3Cl$:Eu.

8. A color picture screen as claimed in claim 1, characterized in that the color picture screen is chosen from the group comprising cathode ray tubes, plasma picture screens, and liquid crystal picture screens.

* * * * *